US010734156B2

(12) United States Patent
Otsubo et al.

(10) Patent No.: US 10,734,156 B2
(45) Date of Patent: Aug. 4, 2020

(54) INDUCTOR COMPONENT

(71) Applicant: Murata Manufacturing Co., Ltd., Kyoto (JP)

(72) Inventors: Yoshihito Otsubo, Kyoto (JP); Shinichiro Banba, Kyoto (JP); Mitsuyoshi Nishide, Kyoto (JP); Norio Sakai, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 687 days.

(21) Appl. No.: 15/481,914

(22) Filed: Apr. 7, 2017

(65) Prior Publication Data

US 2017/0213638 A1 Jul. 27, 2017

Related U.S. Application Data

(63) Continuation of application No. PCT/JP2015/077445, filed on Sep. 29, 2015.

(30) Foreign Application Priority Data

Oct. 9, 2014 (JP) ..... 2014-207767

(51) Int. Cl.
*H01F 27/28* (2006.01)
*H01F 27/29* (2006.01)
*H01F 17/00* (2006.01)

(52) U.S. Cl.
CPC ..... *H01F 27/29* (2013.01); *H01F 17/0033* (2013.01); *H01F 27/2804* (2013.01); *H01F 27/292* (2013.01)

(58) Field of Classification Search
USPC ..... 336/200
See application file for complete search history.

(56) References Cited

U.S. PATENT DOCUMENTS 6,600,404 B1 7/2003 Kajino
8,558,344 B2 * 10/2013 Chen ..... H01L 23/50 257/531

(Continued)

FOREIGN PATENT DOCUMENTS

JP 47-032249 B1 8/1972
JP 61-136623 U 8/1986

(Continued)

OTHER PUBLICATIONS

International Search Report issued in Application No. PCT/JP2015/077445 dated Dec. 15, 2015.

(Continued)

*Primary Examiner* — Ronald Hinson
(74) *Attorney, Agent, or Firm* — Pearne & Gordon LLP

(57) ABSTRACT

An inductor component including an inductor electrode includes an insulating layer and an outer electrode for external connection formed on the upper surface of the insulating layer. The inductor electrode includes a metal pin for input/output that has an upper end surface connected to the outer electrode and that is embedded in the insulating layer. The outer electrode includes a base electrode formed on the upper surface of the insulating layer and composed of a conductive paste, and a surface electrode formed on the base electrode by plating. The surface electrode is formed such that the area of a cross section thereof perpendicular to the thickness direction on an outer layer side away from the base electrode is larger than the area of a cross section thereof perpendicular to the thickness direction on an inner layer side close to the base electrode.

20 Claims, 9 Drawing Sheets

(56) References Cited

U.S. PATENT DOCUMENTS

| | | | | |
|---|---|---|---|---|
| 2004/0113738 | A1* | 6/2004 | Ahn | H01F 5/003 336/200 |
| 2006/0131721 | A1 | 6/2006 | Ito | |
| 2006/0176139 | A1* | 8/2006 | Pleskach | H01F 17/0033 336/223 |
| 2009/0002111 | A1* | 1/2009 | Harrison | H01F 19/04 336/69 |
| 2010/0108370 | A1* | 5/2010 | Kapusta | H05K 1/0218 174/260 |
| 2010/0295191 | A1 | 11/2010 | Kikuchi | |
| 2011/0108317 | A1* | 5/2011 | Harrison | H01F 17/0033 174/266 |
| 2011/0272094 | A1* | 11/2011 | Dalmia | B29C 39/10 156/293 |
| 2015/0201495 | A1* | 7/2015 | Kim | H05K 1/0306 174/255 |

FOREIGN PATENT DOCUMENTS

| | | | |
|---|---|---|---|
| JP | H05-152137 | A | 6/1993 |
| JP | H06-37427 | A | 2/1994 |
| JP | H11-204337 | A | 7/1999 |
| JP | 2000-040620 | A | 2/2000 |
| JP | 2000-173846 | A | 6/2000 |
| JP | 2005-039238 | A | 2/2005 |
| JP | 2006-165212 | A | 6/2006 |
| JP | 2006-179562 | A | 7/2006 |
| JP | 2010-516056 | A | 5/2010 |
| WO | 2009/088000 | A1 | 7/2009 |

OTHER PUBLICATIONS

Written Opinion issued in Application No. PCT/JP2015/077445 dated Dec. 15, 2015.

* cited by examiner

INDUCTOR COMPONENT

This is a continuation of International Application No. PCT/JP2015/077445 filed on Sep. 29, 2015 which claims priority from Japanese Patent Application No. 2014-207767 filed on Oct. 9, 2014. The contents of these applications are incorporated herein by reference in their entireties.

BACKGROUND

Technical Field

The present disclosure relates to an inductor component that includes an inductor electrode disposed inside an insulating layer.

Inductor components in which an inductor element is disposed inside an insulating layer composed of resin, for example, are known currently. As illustrated in FIG. 16, in an inductor component 100 described in Patent Document 1, for example, an endless magnetic layer 102 is formed in a printed wiring board 101, and an inductor electrode 103, which is wound around the endless magnetic layer 102, is further formed.

In this structure, the endless magnetic layer 102 is embedded in the printed wiring board 101. The inductor electrode 103 is constituted by a plurality of linear conductor patterns 104 that are formed on the upper surface of the printed wiring board 101, a plurality of other linear conductor patterns 104 that are formed on the lower surface thereof, and a plurality of through-hole conductors 105 that each connect an end portion of a corresponding one of the linear conductor patterns 104 formed on the upper surface to an end portion of a corresponding one of the linear conductor patterns 104 formed on the lower surface. The inductor electrode 103 and the endless magnetic layer 102 thus formed function as an inductor element disposed inside the printed wiring board 101.

Patent Document 1: Japanese Unexamined Patent Application Publication No. 2000-40620 (see paragraph 0018 and FIG. 1, for example)

BRIEF SUMMARY

As the size of electronic devices has been reduced recently, it is desirable to reduce the size of the inductor component of the above-described type and to enhance the functionality thereof. Accordingly, the inventors have been studying a structure in which metal pins formed by, for example, shearing and processing a wire rod composed of a metal, such as Cu, are used instead of the through-hole conductors 105 that constitute the inductor electrode 103. In the case of using metal pins, the resistivity can be made lower than that in the conventional case of using the through-hole conductors 105, and furthermore, the pitch between adjacent metal pins can be made smaller. Therefore, it is possible to reduce the size of the inductor component and to improve the characteristics of the inductor electrode.

In a case where the inductor component 100 described above is mounted on an outer motherboard, for example, an outer electrode composed of a conductive paste, for example, may be provided on one of the upper surface and the lower surface of the printed wiring board 101, and an end portion of the inductor electrode 103 may be connected to the outer electrode.

Taking into consideration the above-described case, the inventors have been studying a structure in which metal pins are used instead of the through-hole conductors 105 and a metal pin for input/output is directly connected to the outer electrode. In this structure, the metal pins have a smaller number of internal flaws and, unlike a conductive paste, contain no organic substance, for example, and therefore, the resistivity can be decreased and the thermal conductivity can be increased. However, the outer electrode composed of a conductive paste has a larger resistivity than that of the metal pins. Accordingly, if the structure is employed in which the outer electrode is directly connected to the metal pin for input/output, heat may be produced in the connection portion between the metal pin and the outer electrode when a current flows through the inductor electrode. The heat produced in the connection portion between the metal pin and the outer electrode may cause a decrease in the connection reliability, for example.

Accordingly, a structure may be employed for the outer electrode in which a surface electrode formed by plating is laminated on a base electrode composed of a conductive paste. The surface electrode formed by plating has a higher thermal conductivity than that of the base electrode composed of a conductive paste, and therefore, the thermal dissipation characteristics in the case where heat is produced in the connection portion improve. However, in a case of providing a high current to the inductor electrode, the thermal dissipation characteristics need to be further improved.

The present disclosure has been made in view of the above-described problem, and in the case where part of the inductor electrode is constituted by a metal pin, the present disclosure improves the thermal dissipation characteristics of the connection portion between the metal pin and the outer electrode.

An inductor component according to the present disclosure is an inductor component including an inductor electrode, the inductor component including: an insulating layer; and an outer electrode for external connection that is formed on one main surface of the insulating layer. The inductor electrode includes a metal pin for input/output that has one end surface connected to the outer electrode and that is embedded in the insulating layer. The outer electrode includes a base electrode formed on the one main surface of the insulating layer and composed of a conductive paste, and a surface electrode formed on the base electrode by plating. The surface electrode is formed such that the area of a cross section thereof perpendicular to a thickness direction thereof on an outer layer side away from the base electrode is larger than the area of a cross section thereof perpendicular to the thickness direction on an inner layer side close to the base electrode.

The surface electrode formed by plating has a lower resistivity and a higher thermal conductivity than those of the base electrode composed of a conductive paste. Therefore, if the outer electrode is formed of the base electrode composed of a conductive paste and the surface electrode formed by plating, heat produced in the connection portion between the metal pin for input/output and the base electrode when, for example, the inductor electrode is energized can be dissipated via the surface electrode having a high thermal conductivity. Accordingly, the thermal dissipation characteristics of the connection portion between the metal pin for input/output and the outer electrode can be improved.

The surface electrode is formed such that the area of a cross section perpendicular to the thickness direction on the side away from the insulating layer is larger than the area of a cross section perpendicular to the thickness direction on the side closer to the insulating layer. Therefore, a larger amount of heat can be conducted to a location away from the connection portion between the metal pin and the base electrode and dissipated. Accordingly, the thermal dissipation characteristics of the connection portion between the metal pin for input/output and the outer electrode can be further improved.

The strength of close contact between the surface electrode formed by plating and the insulating layer is lower than that between the base electrode composed of a conductive paste and the insulating layer. Therefore, if the structure in which the surface electrode is formed on the insulating layer is employed, the surface electrode may come off. However, in the structure, the base electrode is interposed between the surface electrode formed by plating and the insulating layer, and therefore, it is possible to prevent the outer electrode from coming off from the insulating layer.

Furthermore, the inductor component may further include a coil core disposed inside the insulating layer, and the inductor electrode may be wound around the coil core. Even if this structure in which the inductor electrode is wound around the coil core is employed, the thermal dissipation characteristics of the connection portion between the metal pin for input/output and the outer electrode can be improved.

Furthermore, the outer electrode may be formed on the one main surface of the insulating layer so as to extend from the metal pin in a direction parallel to the one main surface. With this structure, the area of the outer electrode can be made wider. Accordingly, the thermal dissipation characteristics of the inductor component can be improved, and the electrical characteristics of the inductor electrode can also be improved.

Furthermore, a partial region of a surface of the outer electrode may be defined as a connection region for external connection, a region of the surface of the outer electrode other than the connection region may be covered by an insulating cover film, and the connection region may be disposed so as to be apart from the one end surface of the metal pin in plan view (viewed in a direction perpendicular to the one main surface of the insulating layer). In a case where the connection region and the one end surface of the metal pin overlap in plan view, for example, the connection region for external connection is in close vicinity to the connection region between the metal pin and the outer electrode. In a case where the inductor component is externally connected by using a solder paste, heat may be produced in the interface between the surface electrode and the solder paste because the solder paste has a lower resistivity than that of the surface electrode. Accordingly, the connection region and the one end surface of the metal pin are disposed so as to be apart from each other to thereby prevent heat from being produced concentratedly in the vicinity of the one end surface of the metal pin.

Furthermore, the surface electrode and the base electrode may be formed such that the thickness of the surface electrode is larger than the thickness of the base electrode. With this structure, a region (surface electrode) having a low resistivity and a high thermal conductivity becomes large in the outer electrode. Accordingly, the thermal dissipation characteristics of the connection portion between the metal pin for input/output and the outer electrode can be further improved.

Furthermore, the surface electrode may be provided so as to cover the base electrode. With this structure, the base electrode is covered by the surface electrode having a low resistivity and a high thermal conductivity. Accordingly, the thermal dissipation characteristics of the connection portion between the metal pin for input/output and the outer electrode can be further improved.

Furthermore, the outer electrode and the metal pin may be formed such that the area of the outer electrode in plan view is larger than the area of the one end surface of the metal pin. With this structure, it is possible to easily form the connection region for external connection so as to be larger than the one end surface of the metal pin. Accordingly, the strength of external connection of the inductor component can be improved.

Furthermore, the base electrode may be provided so as to cover a portion of the one end surface of the metal pin, and the surface electrode may be provided so as to cover the base electrode and a remaining portion of the one end surface of the metal pin. With this structure, the connection between the outer electrode and the metal pin is partially made by the connection between the metal pin and the surface electrode having a low resistivity. Accordingly, heat produced in the connection portion between the metal pin and the outer electrode when the inductor electrode is energized can be reduced. Further, the connection resistance between the outer electrode and the metal pin can be reduced.

According to the present disclosure, the outer electrode is formed of the base electrode composed of a conductive paste and the surface electrode formed by plating. Therefore, heat produced in the connection portion between the metal pin for input/output and the base electrode when, for example, the inductor electrode is energized can be dissipated via the surface electrode having a high thermal conductivity. As a consequence, the thermal dissipation characteristics of the connection portion between the metal pin for input/output and the outer electrode can be improved. The surface electrode is formed such that the area of a cross section perpendicular to the thickness direction on the outer layer side is larger than the area of a cross section perpendicular to the thickness direction on the inner layer side. Therefore, a larger amount of heat can be conducted to a location away from the connection portion between the metal pin and the base electrode.

DETAILED DESCRIPTION

First Embodiment

Figure 1:
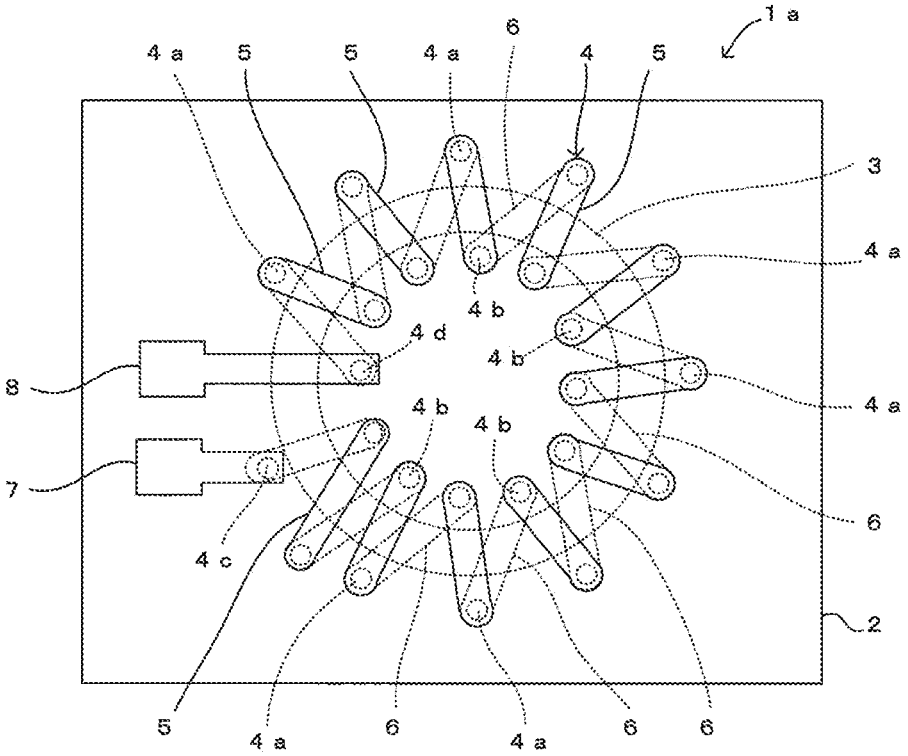
FIG. 1 is a plan view of an inductor component according to a first embodiment of the present disclosure.
Figure 2:
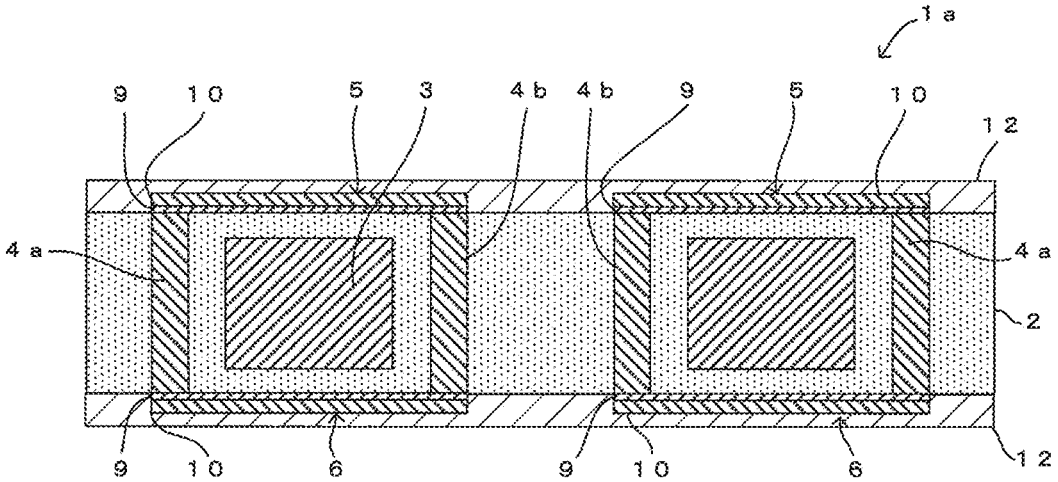
FIG. 2 is a cross-sectional view of the inductor component illustrated in FIG. 1.
Figure 3:
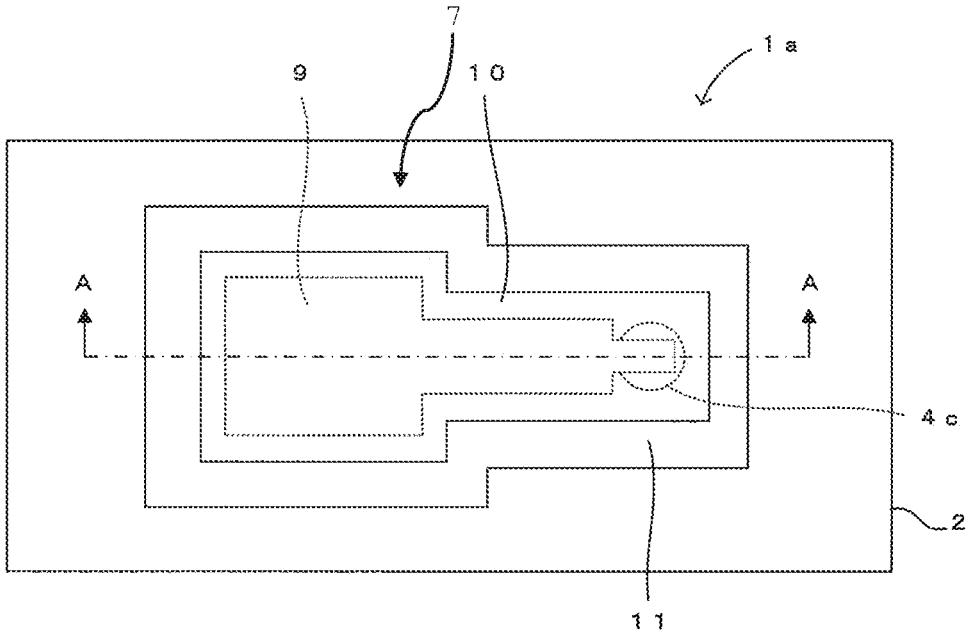
FIG. 3 is a plan view of an outer electrode illustrated in FIG. 1.
Figure 4:
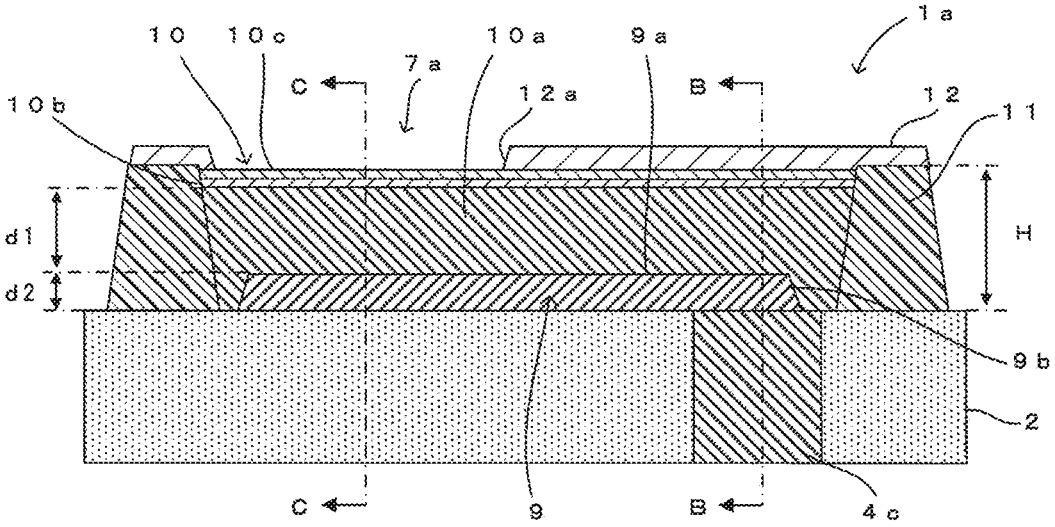
FIG. 4 is a cross-sectional view taken along line A-A of FIG. 3.
Figure 5:
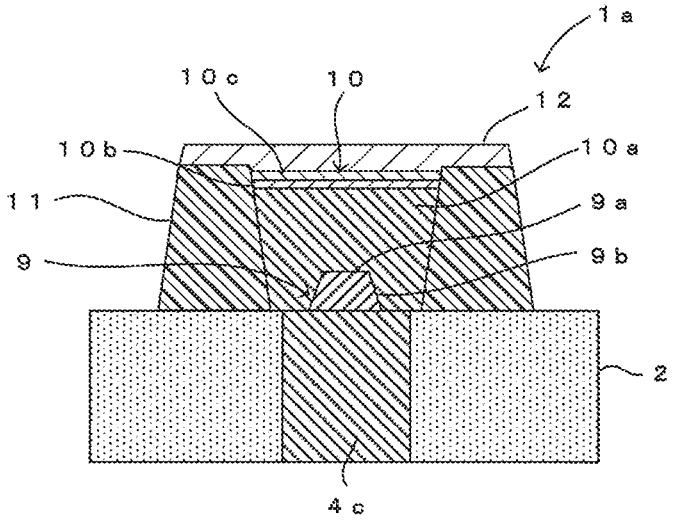
FIG. 5 is a cross-sectional view taken along line B-B of FIG. 4.
Figure 6:
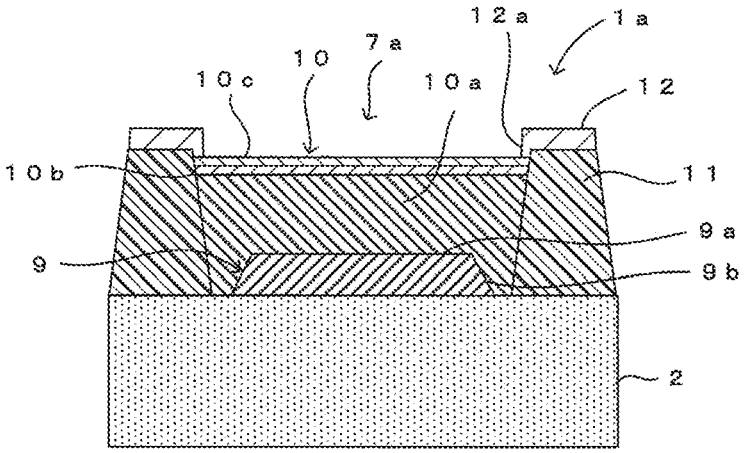
FIG. 6 is a cross-sectional view taken along line C-C of FIG. 4.
Figure 7:
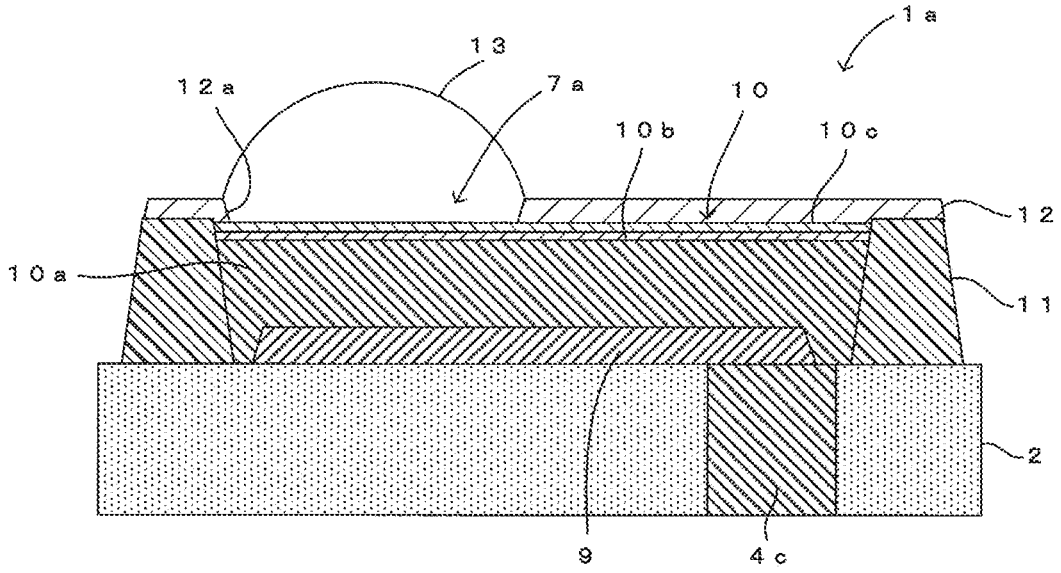
FIG. 7 is a cross-sectional view of the inductor component with a solder disposed on the outer electrode.

An inductor component 1*a* according to a first embodiment of the present disclosure is described with reference to FIG. 1 to FIG. 7. FIG. 1 is a plan view of the inductor component 1*a*. FIG. 2 is a cross-sectional view of the inductor component 1*a*. FIG. 3 is a plan view of an outer electrode. FIG. 4 is a cross-sectional view taken along line A-A of FIG. 3. FIG. 5 is a cross-sectional view taken along line B-B of FIG. 4. FIG. 6 is a cross-sectional view taken along line C-C of FIG. 4. FIG. 7 is a cross-sectional view of the inductor component with a solder disposed on the outer electrode. In FIG. 3, an insulating cover film 12 is not illustrated.

The inductor component 1*a* according to this embodiment includes an insulating layer 2, a magnetic core 3 (corresponding to "coil core" of the present disclosure), which is disposed inside the insulating layer 2, and an inductor electrode 4, which is wound around the magnetic core 3, as illustrated in FIG. 1 and FIG. 2. The inductor component 1*a* is mounted on an outer motherboard, for example, as an inductor element.

The insulating layer 2 is composed of an insulating material, such as an epoxy resin. In the insulating layer 2, the magnetic core 3 is disposed, and the inductor electrode 4, which is wound around the magnetic core 3, is provided.

The magnetic core 3 is composed of a magnetic material, such as a Mn—Zn ferrite, which is used for typical coil cores. The magnetic core 3 according to this embodiment has a ring shape and is used as a toroidal coil core.

The inductor electrode 4 has an upper end surface, which is exposed at the upper surface (corresponding to "one main surface" of the present disclosure) of the insulating layer 2, and a lower end surface, which is exposed at the lower surface of the insulating layer 2, and includes a plurality of metal pins 4*a*, a plurality of metal pins 4*b*, a metal pin 4*c*, and a metal pin 4*d*, which are disposed around the magnetic core 3. The metal pins 4*a*, 4*b*, 4*c*, and 4*d* are composed of a metal material, such as Cu, Au, Ag, Al, Fe, or a Cu alloy (for example, a Cu—Ni alloy), which is typically used for wiring electrodes. The metal pins 4*a*, 4*b*, 4*c*, and 4*d* can be formed by, for example, shearing and processing a metal wire rod composed of any of the metal materials described above.

Among the metal pins 4*a*, 4*b*, 4*c*, and 4*d*, the plurality of metal pins 4*a* and the metal pin 4*c* are arranged along the outer circumference surface of the magnetic core 3, and the plurality of metal pins 4*b* and the metal pin 4*d* are arranged along the inner circumference surface of the magnetic core 3, as illustrated in FIG. 1.

Among the plurality of metal pins 4*a* and the metal pin 4*c* arranged along the outer circumference surface of the magnetic core 3, the metal pin 4*c* disposed at one end of the inductor electrode 4 functions as the metal pin 4*c* for input/output. Among the plurality of metal pins 4*b* and the metal pin 4*d* arranged along the inner circumference surface thereof, the metal pin 4*d* disposed at the other end of the inductor electrode 4 functions as the metal pin 4*d* for input/output. Hereinafter, among the metal pins 4*a* and the metal pin 4*c* arranged along the outer circumference surface of the magnetic core 3, each of the metal pins 4*a* except for the metal pin 4*c* for input/output may be called an outer-side metal pin 4*a*, and among the metal pins 4*b* and the metal pin 4*d* arranged along the inner circumference surface of the magnetic core 3, each of the metal pins 4*b* except for the metal pin 4*d* for input/output may be called an inner-side metal pin 4*b*.

The inner-side metal pins 4*b* are provided so as to be respectively paired with the outer-side metal pins 4*a* to form a plurality of pairs. The upper end surface of each of the outer-side metal pins 4*a* and the upper end surface of a corresponding one of the inner-side metal pins 4*b* that is paired with the outer-side metal pin 4*a* of interest are connected to each other via one upper-side wiring pattern 5 provided on the upper surface of the insulating layer 2. The lower end surface of each of the outer-side metal pins 4*a* and the lower end surface of a corresponding one of the inner-side metal pins 4*b*, the corresponding one of the inner-side metal pins 4*b* being adjacent to the inner-side metal pin 4*b* that is paired with the outer-side metal pin 4*a* of interest on a predetermined side (in the counterclockwise direction in FIG. 1), are connected to each other via one lower-side wiring pattern 6 formed on the lower surface of the insulating layer 2. For each upper-side wiring pattern 5 and each lower-side wiring pattern 6, a typical conductor, such as Cu, Ag, or Al, used to form a wiring conductor can be used. With the structure in which the metal pins 4*a*, 4*b*, 4*c*, and 4*d*, the upper-side wiring patterns 5, and the lower-side wiring patterns 6 are connected as described above, the inductor electrode 4, which is spirally wound around the magnetic core 3 having a ring shape, is formed.

The inductor electrode 4 has ends that are respectively connected to outer electrodes 7 and 8 for external connection, which are formed on the upper surface of the insulating layer 2. Specifically, the outer electrode 7 is connected to the upper end surface (corresponding to "one end surface" of the present disclosure) of the metal pin 4*c* for input/output, and the outer electrode 8 is connected to the upper end surface (corresponding to "one end surface" of the present disclosure) of the metal pin 4*d* for input/output.

The metal pins 4*a*, 4*b*, 4*c*, and 4*d* not only have a smaller number of flaws but also contain a smaller amount of non-metal composition than, for example, a via conductor formed by making a via hole in the insulating layer 2 and filling the via hole with a conductive paste. Therefore, the metal pins 4*a*, 4*b*, 4*c*, and 4*d* have a lower resistivity and a higher thermal conductivity than those of the via conductor. The metal pins 4*a*, 4*b*, 4*c*, and 4*d* described above are used as part of the inductor electrode 4 to thereby reduce the resistance of the inductor electrode 4 as a whole. Further, unlike in the case of the via conductor, it is not necessary to make a through hole, and the pitch between metal pins adjacent to each other among the metal pins 4*a*, 4*b*, 4*c*, and 4*d* can be made smaller. Accordingly, the number of turns of the inductor electrode 4 can be easily increased.

However, in a case where the outer electrodes 7 and 8 are composed of a conductive paste containing a metal, such as Cu, for example, heat may be produced in the connection portion between the metal pin 4*c* for input/output and the outer electrode 7 and in the connection portion between the metal pin 4*d* for input/output and the outer electrode 8 when, for example, the inductor electrode 4 is energized. The heat produced in the connection portions may cause a faulty connection, for which a countermeasure needs to be taken. Accordingly, the outer electrodes 7 and 8 according to this embodiment are formed so as to enhance the thermal dissipation characteristics of the connection portions respectively connected to the metal pins 4*c* and 4*d* for input/output.

The outer electrode 7, for example, is specifically described. As illustrated in FIG. 3 to FIG. 6, the outer electrode 7 includes a base electrode 9, which is formed on the upper surface of the insulating layer 2 and composed of a conductive paste, and a surface electrode 10, which is formed on the base electrode 9 by plating. The outer electrode 7 is surrounded by a dam member 11 composed of a resist resin, for example.

In the connection portion of the outer electrode 7 connected to the metal pin 4*c*, the base electrode 9 is provided so as to cover a portion of the upper end surface of the metal pin 4*c* for input/output, and the surface electrode 10 is provided so as to cover the base electrode 9 and the remaining portion of the upper end surface of the metal pin 4*c* (see FIG. 3 and FIG. 5). The base electrode 9 is composed of a conductive paste that contains a metal, such as Cu, Al, or Ag. The surface electrode 10 is formed of, for example, a Cu-plated layer 10*a*, a Ni-plated layer 10*b*, which is laminated on the Cu-plated layer 10*a*, and an Au-plated layer 10*c*, which is laminated on the Ni-plated layer 10*b*, the plated layers being formed by using the metal composition of the base electrode 9 as their plating cores. In this embodiment, the base electrode 9 and the surface electrode 10 are formed such that the thickness d1 of the surface electrode 10 is larger than the thickness d2 of the base electrode 9 (d1>d2).

The surface electrode 10 is provided so as to cover the surface of the base electrode 9, that is, to cover the upper surface 9*a* and the side surface 9*b* of the base electrode 9 (see FIG. 4 to FIG. 6).

The outer electrode 7 is formed so as to extend from the metal pin 4*c* for input/output in a predetermined direction (to the left of FIG. 1 in this embodiment) on the upper surface of the insulating layer 2 and, in plan view, has an area larger than the area of the upper end surface of the metal pin 4*c* for input/output. As illustrated in FIG. 4, a portion of the surface of the outer electrode 7 is defined as a connection region 7*a* for external connection, and the region other than the connection region 7*a* is covered by the insulating cover film 12. The connection region 7*a* is formed so as to have an area larger than the area of the upper end surface of the metal pin 4*c*. The connection region 7*a* is defined by a cavity 12*a* provided in the insulating cover film 12.

As illustrated in the cross-sectional views of FIG. 4 to FIG. 6, the cross-sectional shape of the surface electrode 10 in the thickness direction is such that the width increases as the distance from the base electrode 9 increases. In other words, the surface electrode 10 is formed such that the area of the cross section perpendicular to the thickness direction increases in a direction from an inner layer side close to the base electrode 9 toward an outer layer side away from the base electrode 9. Note that it is not necessary to form the shape of the surface electrode 10 such that the area (the cross section perpendicular to the thickness direction) gradually increases in the direction from the inner layer side toward the outer layer side. The area needs to be larger on the outer layer side than on the inner layer side.

The outer electrode 7 thus formed is externally connected via a solder paste 13 on the connection region 7*a*, as illustrated in FIG. 7. The solder paste 13 is formed by, for example, mixing a powdery solder and an organic solvent together. The solder paste 13 thus formed has a higher resistivity and a lower thermal conductivity than those of the surface electrode 10 as in the case of the base electrode 9. Therefore, heat may be produced in the connection interface between the surface electrode 10 and the solder paste 13 when, for example, the inductor electrode 4 is energized. Accordingly, in this embodiment, in order to further improve the thermal dissipation characteristics of the connection portion between the outer electrode 7 and the metal pin 4*c* for input/output, the connection region 7*a* and the upper end surface of the metal pin 4*c* are disposed so as to be apart from each other in plan view. The outer electrodes 7 and 8 are formed so as to have substantially the same structure.

(Method for Forming Outer Electrode)

Figure 8A:
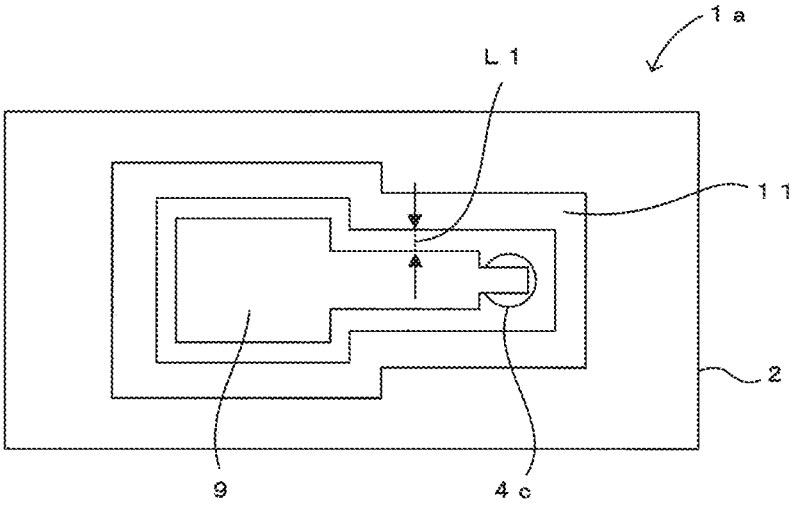
FIGS. 8A-8C include diagrams for describing a method for forming the outer electrode.
Figure 8B:
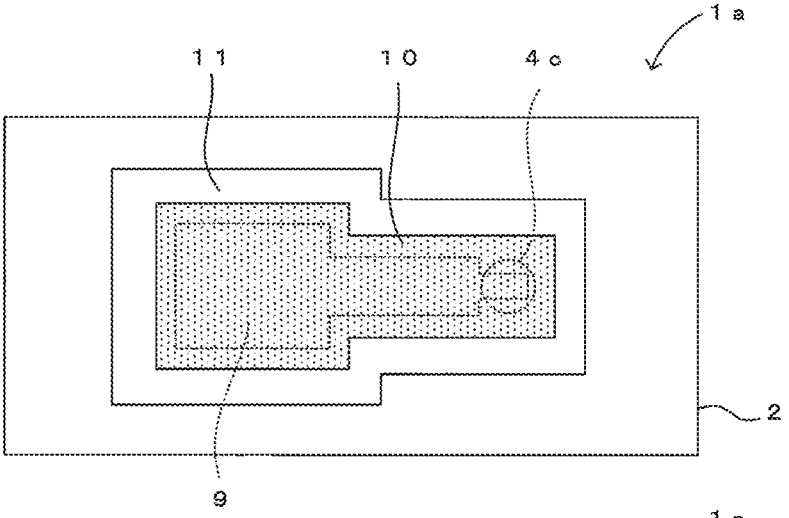
Figure 8C:
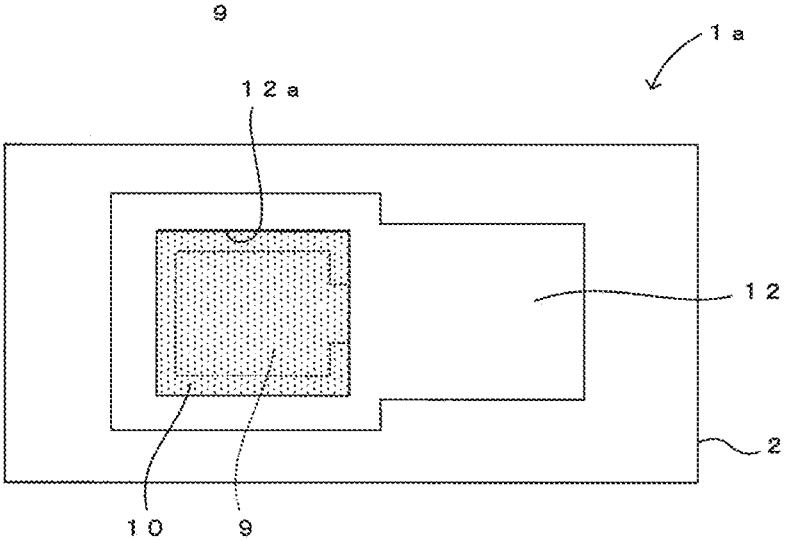

Now, a method for forming the outer electrode 7 is described with reference to FIGS. 8A-8C. FIGS. 8A-8C include diagrams for describing a method for forming the outer electrode, and FIGS. 8A to 8C illustrate steps for forming. The dotted portion in FIG. 8B and in FIG. 8C represents the surface electrode 10.

First, the magnetic core 3 and the metal pins 4*a*, 4*b*, 4*c*, and 4*d* are embedded in the insulating layer 2. Here, the upper surface and the lower surface of the insulating layer 2 are polished or grinded so that the upper end surface and the lower end surface of each of the metal pins 4*a*, 4*b*, 4*c*, and 4*d* are respectively exposed at the upper surface and the lower surface of the insulating layer 2.

Next, the base electrode 9 having a predetermined pattern shape is formed by screen printing using a conductive paste that contains a metal, such as Cu. Here, the base electrode 9 is formed so as to cover a portion of the upper end surface of the metal pin 4*c*. Thereafter, the dam member 11 is formed so as to surround the base electrode 9. Here, the base electrode 9 and the dam member 11 are disposed so as to be apart from each other by a predetermined distance L1 so that the base electrode 9 is not in contact with the dam member 11 (see FIG. 8A). The dam member 11 is formed such that the height H (see FIG. 4) from the one main surface of the insulating layer 2 is larger than the thickness d2 of the base electrode 9.

Subsequently, the Cu-plated layer 10*a*, the Ni-plated layer 10*b*, and the Au-plated layer 10*c* are laminated in this order on the surface of the base electrode 9 while the metal composition of the base electrode 9 is used as their plating cores to form the surface electrode 10, as illustrated in FIG. 8B. Here, the surface electrode 10 is formed such that the thickness d1 of the surface electrode 10 is larger than the thickness of the base electrode 9. The surface electrode 10 is formed so as to fill the region surrounded by the dam member 11. Specifically, the dam member 11 is formed by printing or applying a liquid resist resin having a predetermined viscosity on the upper surface of the insulating layer 2, the liquid resist resin solidifying thereafter. Here, the resist resin of the dam member 11 spreads outward, and therefore, the cross section of the dam member 11 has a shape that tapers in an upward direction from the one main surface of the insulating layer 2 (see FIG. 4). Therefore, the area of the cross section of the surface electrode 10, which is formed so as to fill the region surrounded by the dam member 11, the cross section being perpendicular to the thickness direction, increases in the direction from the inner layer side close to the base electrode 9 toward the outer layer side away from the base electrode. Instead of the Au-plated layer 10*c*, a Sn-plated layer, for example, may be laminated.

Subsequently, as illustrated in FIG. 8C, the insulating cover film 12 for covering the outer electrode 7 is formed. Here, the cavity 12*a* is provided in the insulating cover film 12 so that a portion (connection region 7*a*) of the outer electrode 7, the portion being defined as a region for external connection, is exposed. In this embodiment, each of the upper-side wiring patterns 5 and the lower-side wiring patterns 6 is similarly formed as a multilayered structure formed of the base electrode 9 and the surface electrode 10 (see FIG. 2), and the upper-side wiring patterns 5 and the outer electrode 7 are formed simultaneously, for example.

Consequently, according to the above-described embodiment, the outer electrodes 7 and 8 are each formed of the base electrode 9, which is composed of a conductive paste, and the surface electrode 10, which is formed by plating. Accordingly, heat produced in the connection portion between the metal pin 4*c* and the base electrode 9 and in the connection portion between the metal pin 4*d* and the base electrode 9 when, for example, the inductor electrode 4 is energized can be dissipated via the surface electrode 10 having a high thermal conductivity. As a consequence, the thermal dissipation characteristics of the connection portion between the metal pin 4*c* for input/output and the outer electrode 7 and the connection portion between the metal pin 4*d* for input/output and the outer electrode 8 can be improved.

The surface electrode 10 is formed such that the area of a cross section perpendicular to the thickness direction on the outer layer side is larger than the area of a cross section perpendicular to the thickness direction on the inner layer side. Therefore, a larger amount of heat can be conducted to a location away from the connection portion between the metal pin 4*c* and the base electrode 9 and to a location away from the connection portion between the metal pin 4*d* and the base electrode 9 and dissipated. As a consequence, the thermal dissipation characteristics of the connection portion between the metal pin 4*c* for input/output and the outer electrode 7 and the connection portion between the metal pin 4*d* for input/output and the outer electrode 8 can be further improved.

The strength of close contact between the surface electrode 10 formed by plating and the insulating layer 2 is lower than that between the base electrode 9 composed of a conductive paste and the insulating layer 2. Therefore, if the structure in which the surface electrode 10 is formed on the insulating layer 2 is employed, the surface electrode 10 may come off. However, in the structure, the base electrode 9 is interposed between the surface electrode 10 and the insulating layer 2, and therefore, it is possible to prevent the outer electrodes 7 and 8 from coming off from the insulating layer 2.

The outer electrodes 7 and 8 are formed so as to respectively extend from the metal pins 4*c* and 4*d* in a predetermined direction on the upper surface of the insulating layer 2. With this structure, the areas of the outer electrodes 7 and 8 can be easily increased. As a consequence, the thermal dissipation characteristics of the inductor component 1*a* can be improved, and the electrical characteristics of the inductor electrode 4 can also be improved.

The outer electrodes 7 and 8 are formed such that the areas of the outer electrodes 7 and 8 in plan view are respectively larger than the areas of the upper end surfaces of the metal pins 4*c* and 4*d* for input/output. Accordingly, the connection region 7*a* can be easily made larger than the upper end surface of the metal pin 4*c* and that of the metal pin 4*d*. As a consequence, the strength of external connection of the inductor component 1*a* can be improved.

The surface electrode 10 and the base electrode 9 are formed such that the thickness d1 of the surface electrode 10 is larger than the thickness d2 of the base electrode 9, and therefore, a region (surface electrode 10) having a low resistivity and a high thermal conductivity becomes large in the outer electrodes 7 and 8. As a consequence, the thermal dissipation characteristics of the connection portion between the metal pin 4*c* for input/output and the outer electrode 7 and the connection portion between the metal pin 4*d* for input/output and the outer electrode 8 can be further improved.

The surface electrode 10 is provided so as to cover not only the upper surface 9*a* of the base electrode 9 but also the side surface 9*b* thereof. As a consequence, the thermal dissipation characteristics of the connection portion between the metal pin 4*c* for input/output and the outer electrode 7 and the connection portion between the metal pin 4*d* for input/output and the outer electrode 8 can be further improved.

The base electrode 9 is provided so as to cover a portion of the upper end surface of the metal pin 4*c* and a portion of the upper end surface of the metal pin 4*d*. The surface electrode 10 is provided so as to cover the base electrode 9, the remaining portion of the upper end surface of the metal pin 4*c*, and the remaining portion of the upper end surface of the metal pin 4*d*. With this structure, the connection between the outer electrode 7 and the metal pin 4*c* is partially made by the connection between the metal pin 4*c* and the surface electrode 10 having a low resistivity, and the connection between the outer electrode 8 and the metal pin 4*d* is partially made by the connection between the metal pin 4*d* and the surface electrode 10 having a low resistivity. As a consequence, heat produced in the connection portion between the metal pin 4*c* and the outer electrode 7 and in the connection portion between the metal pin 4*d* and the outer electrode 8 when the inductor electrode 4 is energized can be reduced. Further, the connection resistance between the metal pin 4*c* for input/output and the outer electrode 7 and the connection resistance between the metal pin 4*d* for input/output and the outer electrode 8 can be reduced.

Second Embodiment

Figure 9:
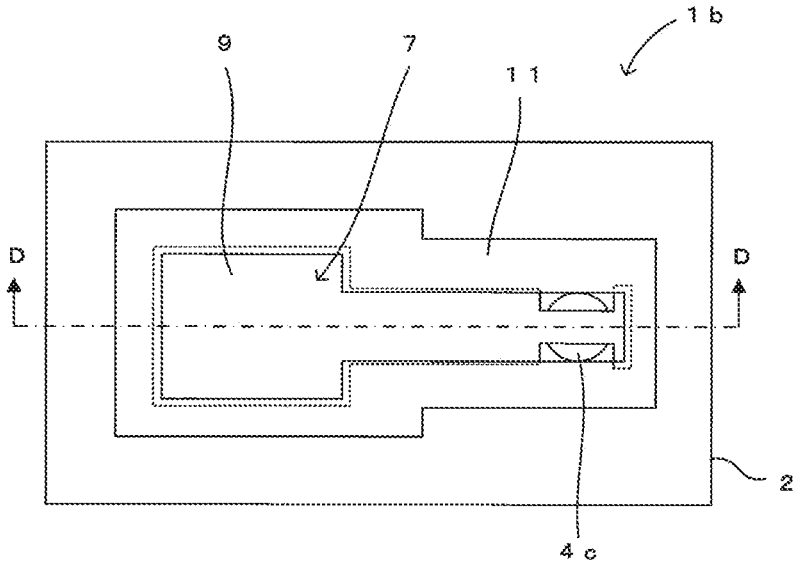
FIG. 9 is a plan view of an outer electrode of an inductor component according to a second embodiment of the present disclosure.
Figure 10:
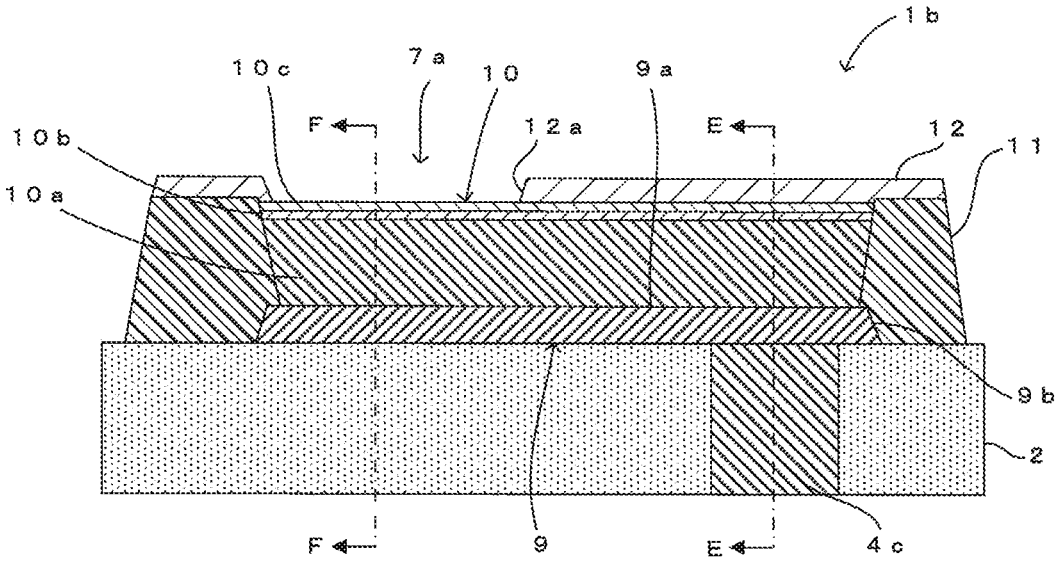
FIG. 10 is a cross-sectional view taken along line D-D of FIG. 9.
Figure 11:
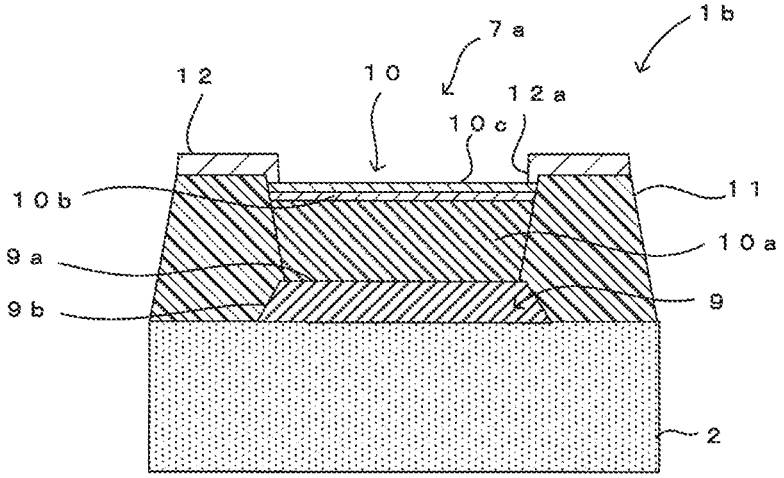
FIG. 11 is a cross-sectional view taken along line F-F of FIG. 10.

An inductor component 1*b* according to a second embodiment of the present disclosure is described with reference to FIG. 9 to FIG. 11. FIG. 9 is a plan view of an outer electrode 7 of the inductor component 1*b*. FIG. 10 is a cross-sectional view taken along line D-D of FIG. 9. FIG. 11 is a cross-sectional view taken along line F-F of FIG. 10. In FIG. 9, the insulating cover film 12 is not illustrated.

The structure of the inductor component 1*b* according to this embodiment is different from that of the inductor component 1*a* according to the first embodiment described with reference to FIG. 1 to FIG. 7 in that the dam member 11 is provided so as to cover the peripheral edge of the outer electrode 7 and the surface electrode 10 is not in contact with the one main surface of the insulating layer 2 accordingly, as illustrated in FIG. 9 to FIG. 11. The remaining structure is the same as that of the inductor component 1*a* according to the first embodiment, and therefore, the same reference numerals are given to omit description of the remaining structure. In FIG. 9, the surface electrode 10 and the insulating cover film 12 are not illustrated.

In the above-described structure, the dam member 11 is provided so as to cover the peripheral edge of the base electrode 9 and so as to not cover the connection portion of the base electrode 9 connected to the metal pin 4*c* for input/output, as illustrated in FIG. 9 to FIG. 11. A cross-sectional view taken along line E-E of FIG. 10, the cross-sectional view showing the cross section of the connection portion of the outer electrode 7 connected to the metal pin 4*c*, is substantially the same as that illustrated in FIG. 5. That is, the base electrode 9 covers a portion of the upper end surface of the metal pin 4*c*, and the surface electrode 10 covers the remaining portion. The surface electrode 10 according to this embodiment covers the connection portion connected to the metal pin 4*c* but does not cover the side surface 9*b* of the base electrode 9.

With the above-described structure, the surface electrode 10 having a low strength of close contact with the insulating layer 2 is not in contact with the insulating layer 2, and therefore, the possibility that the outer electrode 7 comes off from the insulating layer 2 when thermal stress, for example, is produced can be reduced.

(Modification of Outer Electrode)

Figure 12:
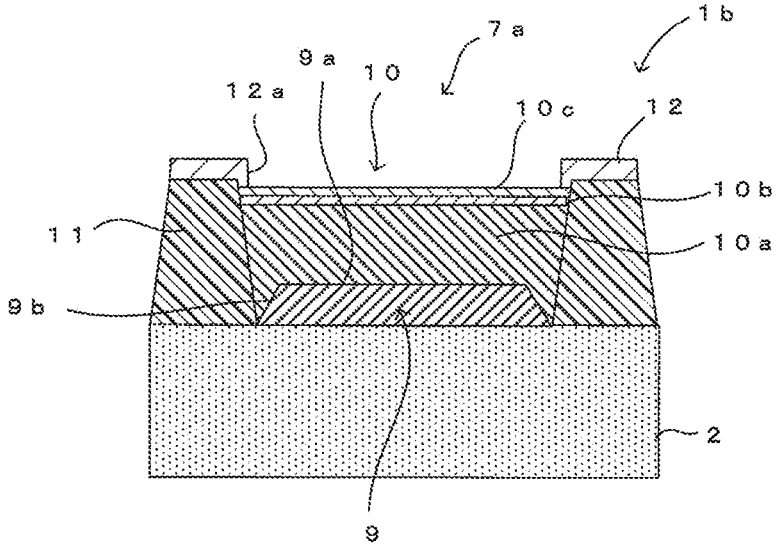
FIG. 12 is a diagram illustrating a modification of the outer electrode.

Now, a modification of the outer electrode 7 is described with reference to FIG. 12. FIG. 12 is a diagram illustrating a modification of the outer electrode 7 and corresponds to FIG. 11. For example, as illustrated in FIG. 12, a structure may be employed in which the dam member 11 is in contact with the base electrode 9 but does not cover the base electrode 9. In this structure, the surface electrode 10 is provided so as to cover the upper surface 9*a* and the side surface 9*b* of the base electrode 9. With the structure, the region in which the surface electrode 10 having a low resistivity and a high thermal conductivity is formed can be made wider to thereby improve the thermal dissipation characteristics of the connection portion between the outer electrode 7 and the metal pin 4*c*. Further, the surface electrode 10 is substantially not in contact with the insulating layer 2, and therefore, the possibility that the outer electrode 7 comes off from the insulating layer 2 can be reduced. Note that the structure according to this modification is applicable to the inductor component 1*a* according to the first embodiment.

Third Embodiment

Figure 13:
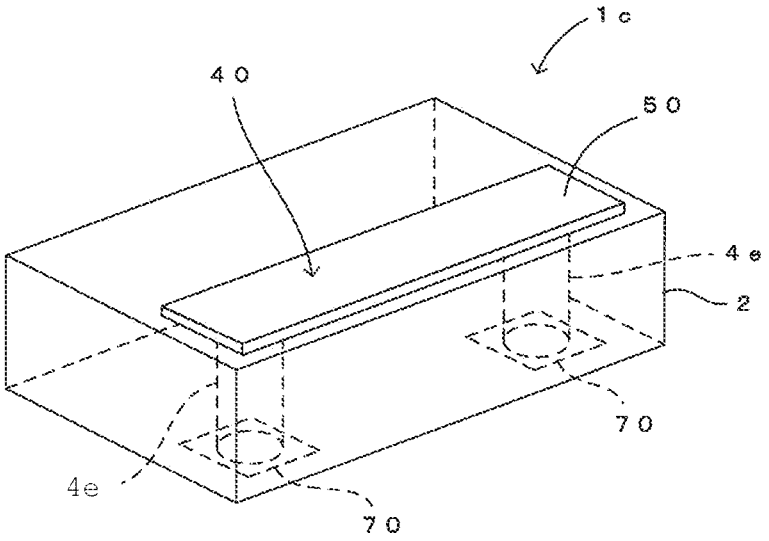
FIG. 13 is a perspective view of an inductor component according to a third embodiment of the present disclosure.
Figure 14:
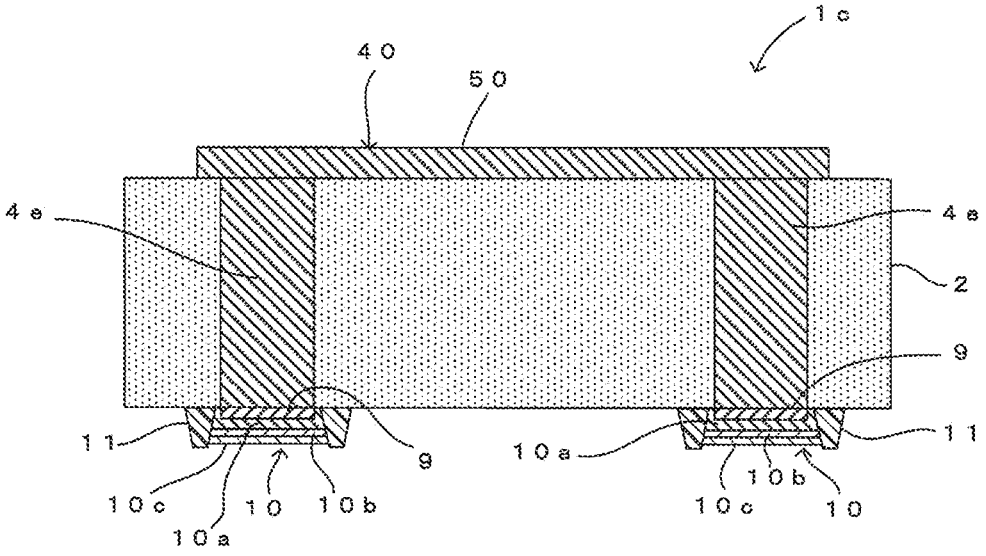
FIG. 14 is a cross-sectional view of the inductor component illustrated in FIG. 13.

Now, an inductor component 1*c* according to a third embodiment of the present disclosure is described with reference to FIG. 13 and FIG. 14. FIG. 13 is a perspective view of the inductor component 1*c*. FIG. 14 is a cross-sectional view of the inductor component 1*c*.

The inductor component 1*c* according to this embodiment is different from the inductor component 1*a* according to the first embodiment described with reference to FIG. 1 to FIG. 7 in that the magnetic core 3 embedded in the insulating layer 2 is not included and that an inductor electrode 40 having a different structure is included, as illustrated in FIG. 13 and FIG. 14. The portions given the same reference numerals as those in FIG. 1 to FIG. 7 have the same structures as in FIG. 1 to FIG. 7, and therefore, description thereof is omitted.

In this structure, the inductor electrode 40 includes two metal pins 4*e* for input/output, which are embedded in the insulating layer 2 with the upper end surface and the lower end surface thereof exposed at the insulating layer 2, and a connection conductor 50, which connects the upper end surfaces of the metal pins 4*e* to each other. Here, the metal pins 4*e* are disposed upright and substantially parallel to each other. The lower end surfaces of the metal pins 4*e* are respectively connected to the outer electrodes 70 for external connection. The outer electrodes 70 have a structure substantially the same as that of the outer electrodes 7 and 8 according to the first embodiment. The surface electrode 10 is formed such that a cross section perpendicular to the thickness direction on the outer layer side away from the base electrode 9 is larger than a cross section perpendicular to the thickness direction on the inner layer side close to the base electrode 9, as illustrated in FIG. 14.

With the inductor component 1*c* thus formed, which does not include the magnetic core 3, the thermal dissipation characteristics of the connection portions between the outer electrodes 70 and the metal pins 4*e* can be improved.

Figure 15:
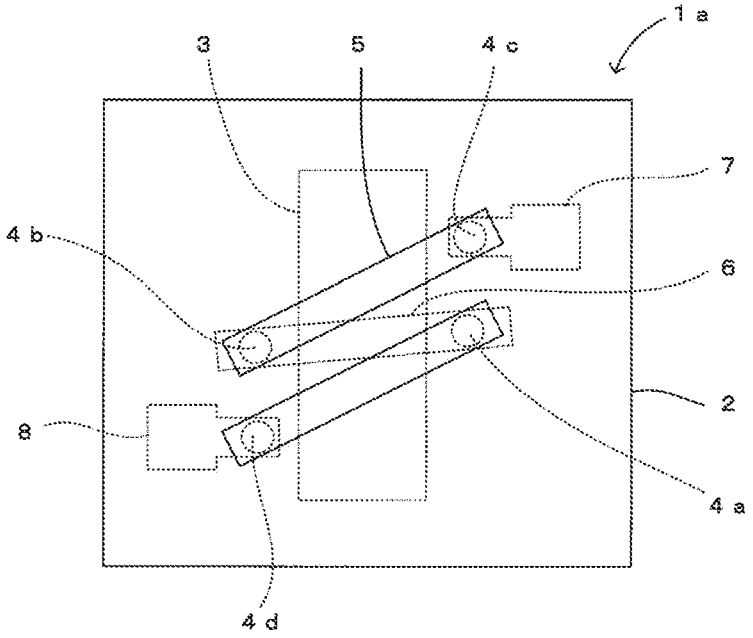
FIG. 15 is a diagram illustrating a modification of a magnetic core.
Figure 16:
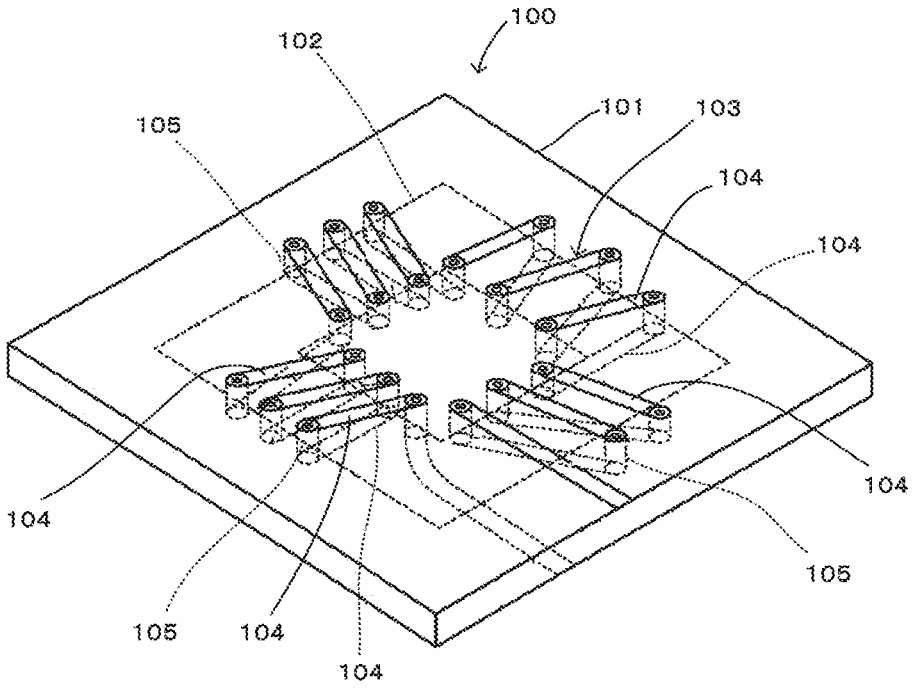
FIG. 16 is a perspective view of a conventional inductor component.

Note that the present disclosure is not limited to the above-described embodiments, and various modifications other than those described above can be made without departing from the spirit of the present disclosure. For example, the case where the magnetic core 3 has a ring shape is described in the first and second embodiments described above; however, the magnetic core 3 may be formed into a rod shape, as illustrated in FIG. 15. FIG. 15 is a diagram illustrating a modification of the magnetic core 3.

In the inductor components 1*a* and 1*b* according to the first and second embodiments described above, the base electrode 9 is formed so as to cover a portion of the upper end surface of the metal pin 4*c* and that of the metal pin 4*d*; however, the base electrode 9 may be formed to entirely cover the upper end surfaces, and the surface electrode 10 may be laminated on the base electrode 9.

INDUSTRIAL APPLICABILITY

The present disclosure is applicable to a wide variety of inductor components in which an inductor electrode is formed in an insulating layer.

REFERENCE SIGNS LIST

1*a* to 1*c* inductor component
2 insulating layer
3 magnetic core (coil core)
4, 40 inductor electrode
4*c*, 4*d*, 4*e* metal pin for input/output
7, 8, 70 outer electrode
7*a* connection region
9 base electrode
10 surface electrode
12 insulating cover film

The invention claimed is:

1. An inductor component including an inductor electrode, comprising:

an insulating layer; and an outer electrode for external connection on one main surface of the insulating layer, wherein the inductor electrode includes a metal pin for input/output that has one end surface connected to the outer electrode and that is embedded in the insulating layer, the outer electrode includes a base electrode on the one main surface of the insulating layer, the base electrode being composed of a conductive paste, and a surface electrode on the base electrode, the surface electrode comprising plating, and an area of a cross section of the surface electrode perpendicular to a thickness direction of the surface electrode on an outer layer side away from the base electrode is larger than an area of a cross section of the surface electrode perpendicular to the thickness direction on an inner layer side close to the base electrode.

2. The inductor component according to claim 1, wherein the surface electrode is provided so as to cover the base electrode.

3. The inductor component according to claim 1, wherein an area of the outer electrode in plan view is larger than an area of the one end surface of the metal pin.

4. The inductor component according to claim 1, wherein
the base electrode is provided so as to cover a portion of the one end surface of the metal pin, and
the surface electrode is provided so as to cover the base electrode and a remaining portion of the one end surface of the metal pin.

5. The inductor component according to claim 1, further comprising
a coil core disposed inside the insulating layer, wherein
the inductor electrode is wound around the coil core.

6. The inductor component according to claim 5, wherein
the outer electrode is located on the one main surface of the insulating layer so as to extend from the metal pin in a direction parallel to the one main surface.

7. The inductor component according to claim 5, wherein
a partial region of a surface of the outer electrode is defined as a connection region for external connection,
a region of the surface of the outer electrode other than the connection region is covered by an insulating cover film, and
the connection region is disposed so as to be apart from the one end surface of the metal pin in plan view.

8. The inductor component according to claim 5, wherein
a thickness of the surface electrode is larger than a thickness of the base electrode.

9. The inductor component according to claim 5, wherein
the surface electrode is provided so as to cover the base electrode.

10. The inductor component according to claim 5, wherein
an area of the outer electrode in plan view is larger than an area of the one end surface of the metal pin.

11. The inductor component according to claim 1, wherein
the outer electrode is located on the one main surface of the insulating layer so as to extend from the metal pin in a direction parallel to the one main surface.

12. The inductor component according to claim 11, wherein
a partial region of a surface of the outer electrode is defined as a connection region for external connection,
a region of the surface of the outer electrode other than the connection region is covered by an insulating cover film, and
the connection region is disposed so as to be apart from the one end surface of the metal pin in plan view.

13. The inductor component according to claim 11, wherein
a thickness of the surface electrode is larger than a thickness of the base electrode.

14. The inductor component according to claim 11, wherein
the surface electrode is provided so as to cover the base electrode.

15. The inductor component according to claim 11, wherein
an area of the outer electrode in plan view is larger than an area of the one end surface of the metal pin.

16. The inductor component according to claim 1, wherein
a partial region of a surface of the outer electrode is defined as a connection region for external connection,
a region of the surface of the outer electrode other than the connection region is covered by an insulating cover film, and
the connection region is disposed so as to be apart from the one end surface of the metal pin in plan view.

17. The inductor component according to claim 16, wherein
a thickness of the surface electrode is larger than a thickness of the base electrode.

18. The inductor component according to claim 16, wherein
the surface electrode is provided so as to cover the base electrode.

19. The inductor component according to claim 1, wherein
a thickness of the surface electrode is larger than a thickness of the base electrode.

20. The inductor component according to claim 19, wherein
the surface electrode is provided so as to cover the base electrode.

* * * * *